US008168141B2

(12) United States Patent
Ramsay et al.

(10) Patent No.: US 8,168,141 B2
(45) Date of Patent: May 1, 2012

(54) HOLDER FOR HOLDING A CARRIER FOR INSERTION INTO A CYLINDRICAL WELL

(75) Inventors: Steven Ramsay, Melbourne (AU); Florian Bichteler, Innsbruck (AT); Wolfgang Guggenbichler, Rum (AT)

(73) Assignee: BIOCRATES Life Sciences AG, Innsbruck (AT)

( * ) Notice: Subject to any disclaimer, the term of this patent is extended or adjusted under 35 U.S.C. 154(b) by 732 days.

(21) Appl. No.: 12/202,063

(22) Filed: Aug. 29, 2008

(65) Prior Publication Data

US 2009/0072109 A1 Mar. 19, 2009

(30) Foreign Application Priority Data

Sep. 13, 2007 (DE) ..... 10 2007 043 614

(51) Int. Cl.
*B01L 3/00* (2006.01)
*A47F 5/00* (2006.01)
*A47G 29/00* (2006.01)

(52) U.S. Cl. ..... 422/503; 248/309.1; 211/71.01

(58) Field of Classification Search ..... 422/102, 422/401, 405, 407, 552, 553, 948; 248/309.1
See application file for complete search history.

(56) References Cited

U.S. PATENT DOCUMENTS 4,125,436 A 11/1978 Liner
5,076,445 A * 12/1991 Landsberger ..... 211/74
5,208,161 A 5/1993 Saunders et al.
5,795,748 A * 8/1998 Cottingham ..... 435/91.2
6,665,073 B2 * 12/2003 Tuunanen ..... 356/440
2004/0033170 A1 * 2/2004 DeWalch ..... 422/102
2007/0003965 A1 * 1/2007 Ramsay et al. ..... 435/6
2007/0004044 A1 * 1/2007 Ramsay et al. ..... 436/86

FOREIGN PATENT DOCUMENTS

DE 691 09 651 T2 9/1995
DE 693 22 573 T2 8/1999
DE 698 31 408 T2 3/2006
EP 0 495 213 B1 5/1995
EP 0 834 729 A2 4/1998
EP 0 590 513 B1 12/1998
WO WO-98/55233 12/1998

* cited by examiner

*Primary Examiner* — In Suk Bullock
*Assistant Examiner* — Bryan Kilpatrick
(74) *Attorney, Agent, or Firm* — Muncy, Geissler, Olds & Lowe, PLLC

(57) ABSTRACT

The invention relates to a holder for holding a carrier, wherein the holder is inserted into a cylinder-shaped well, for example, of a multiwell plate. In addition the invention relates to a multiwell plate with such a holder. In order to provide a possibility for the reliable support of a carrier in a holder, wherein the holder ensures a secure and specified positioning of the carrier in a well and reliably prevents the carrier and the holder from falling out of the well, a holder is proposed for insertion into a cylindrical well and to support the carrier. The holder comprises a support, a holding piece and a connecting piece which connects the supporting piece with the holding piece, wherein the holder together with the lateral external surfaces of the supporting piece, the holding piece and/or connecting piece lies against at least one lateral internal surface of the well, and wherein the carrier is inserted on the support and under the holding piece.

17 Claims, 4 Drawing Sheets

HOLDER FOR HOLDING A CARRIER FOR INSERTION INTO A CYLINDRICAL WELL

The invention claims priority of the German priority application DE 10 2007 043 614.0 filed on Sep. 13, 2007.

BACKGROUND OF THE INVENTION

1. Field of the Invention

The invention concerns a holder for holding a carrier where the holder is inserted into a cylindrical well, for example, into a multiwell plate. In addition the invention relates to a multiwell plate with this type of holder.

2. Brief Discussion of the Related Art

This kind of holder in inserted in the recesses or wells of titration and/or filtration plates and serves for the positioning of a carrier at a specified height above the bottom of the wells.

Multiwell plates, for example, plates with 96 wells, are a proven device in biomedical research, analytical chemistry and clinical diagnosis and are standard technology. There is a wide range of variants of classic multiwell plates. While the classical variant is primarily used for parallel support and handling of liquids and reaction solutions, there are variants of multiwell plates for special analytical needs, e.g. the standard filtration plate for cleaning fluids with built-in filters in the base. There are also specific variants such as the use of a double plate for the cultivation of membrane cell cultures For chemical-analytical measurement methods which are also used in miniaturised form in modern research in the fields of genomics, proteomics and metabolomics, one sometimes needs very complex constructions. This kind of construction is described below. In metabolomics, one treis to analyse large sections of the metaboloms, i.e. the totality of the natural metabolites occurring in an organism, as efficiently as possible from very small sample volumes, wherein several steps are involved in handling the sample. The usual multiwell plate format as used in life sciences is employed. This requires additional functionality in the wells of the multiwell plate. This can be e.g. an additional base in form of a fleece disc which, inter alia, can serve as a reaction site, as a reservoir for chemicals or for an immobilisation site.

Multiwell plates have been used for many years as a standard utensil in biomedical and chemical research either for the simple presentation or handling of liquid volumes in a highly parallel manner or for the performance of reactions, cleaning, extractions and substance identification. An overview of the many applications of such plates is provided in the catalogues of relevant manufacturers such as PALL, Millipore, Costar, Nunc, Whatman and many more.

In addition, wells are also used as a quasi reaction cell with lower outlet and are described, for example, in W0/1992/002303A1. Further it is possible to combine several reaction or extraction processes by the combination of several multiwell plates as described, for example, in WO/1999/019067A1.

A further development is represented by the integration of tools and structures in the wells of the multiwell plates. This includes both the fixed installation of filters (WO/2000/066268A2) as well as the use of a second plate with wells having a smaller diameter in order to produce a double-walled structure and thus compartmentalisation into two reaction sites as described in (WO/2002/102965A2).

When positioning a carrier in a well, e.g. a filter or fleece disc, it is necessary to prevent the carrier from falling out of the holder or out of the well. In addition, some applications require that the carrier be placed into a gase or liquid charged into the well.

U.S. Pat. No. 5,208,161 describes a cylindrical holder at the bottom of which is a lattice-like insert. In the upper part of the cylindrical insert is a circular ring which prevents a carrier from sliding out.

EP 0 834 729 A2 describes a multi-piece cylindrical insert with a lower part having a cylindrical wall from which project supporting elements with holding projections in the inner area. A filter disc is laid on the supporting elements and is fixed in position by means of an upper insert which is inserted into the lower insert.

DE 698 31 408 A2 describes a filter plate for connecting several filter holding elements in a matrix. Each filter holding element has holding spigots at its lower part and between which wells are arranged.

U.S. Pat. No. 4,125,426 shows an insert for a laboratory plate, wherein a holding plate is connected via a rod with a circular gripping piece which abuts a well at the top of the laboratory plate. The gripping piece serves as an aid to movement.

DE 691 09 651T2 shows a cylindrical cell culture insert at the upper edge of which there are surfaces facing outwards with a well at the top for the support.

SUMMARY OF THE INVENTION

Against this background, the object of the invention is to provide an option for reliable holding of a carrier in a holder where the holder ensures a secure and defined positioning of the carrier in a well and reliably prevents the carrier and the holder from falling out of the well.

This object is solved by a holder to be inserted into a cylinder-shaped well for the support of a carrier comprising: a holding piece which, after the insertion of the holder into the well, is arranged horizontally in the latter and serves for fixing of the carrier lying on a support, the support arranged in the well under the holding piece and containing interconnected supporting pieces, the supporting pieces are arranged, after insertion of the holder in the well horizontally in the latter, at least one connecting piece substantially running vertically in the well and connecting the support with the holding piece, wherein the carrier is insertable on the support and under the holding piece; and wherein, after the insertion of the holder into the well, at least one of the lateral external surfaces of the support, the holding piece and/or the connecting piece of the holder contacts at least one lateral internal surface of the well.

The holder in accordance with the invention is in the form of an insert for use with multiwell plates or microwell plates and enables a carrier, for example in the form of fleece or filter discs, to be positioned at a specified height above the bottom of the well.

The holder also prevents the carrier from sliding out and allows loose seating of the latter. By this, and the maintenance of the distance with respect to the lateral internal wall of the well, allows purging with or placing in gaseous or liquid substances.

The invention is based on the idea of a simply producable holder which can be inserted easily into a well, for example, of a multiwell or a microwell plate. It is necessary that the holder is always positioned at a precisely specified location in the well so that the carrier is located at a well-defined position in the well.

The holder in accordance with the invention allows both manual as well as automatic insertion.

In its basic form, the holder consists of a support and a holding piece while there is a connecting piece between the support and the holding piece. The connecting piece ensures that a specified distance is maintained between the support and the holding piece so that the carrier can be inserted between the support and the holding piece. The support and/or the holding piece as well as the connecting piece are arranged in such a way that the lateral external surfaces of the components of the holder lie against at least one lateral internal surface of the well when the holder is inserted in the well. The positioning of the lateral external surfaces of the components of the holder against at least one lateral internal surface of the well ensures that the holder is positioned at a specified location in the well and cannot tilt, slip or fall out. This position may be either a specified diameter of the well or a specified distance from the bottom of the well.

Alternatively, it is possible that the well has lugs or recesses with which the holder engages or against which it butts when inserted.

In an advantageous embodiment, the support is arranged in an substantial horizontal manner, wherein the holding piece is substantially parallel to the support and is also horizontal. The support may be circular or star-shaped. The holding piece may be rod-shaped in the simplest variant. It is also possible that the holding piece is U-shaped, V-shaped or circular.

In the simplest embodiment, a connecting piece is provided between the support and the holding piece. It is especially advantageous, however, when two connecting pieces are provided, the lateral external surfaces of each of which lie against at least one lateral internal surface of the well and thus ensure a definite positioning while the holder cannot tip or slip into the well.

In an advantageous embodiment, the support includes three essentially horizontal supporting pieces which are arranged in the shape of a star or a triangle, and where the carrier lies on the supporting pieces. When inserted, the outward facing ends of the supporting pieces lie adjacent to the internal surface(s) of the well.

It is also possible that only one external lateral surface of a supporting piece lies adjacent to the lateral internal surface of the well while, for example, one or more of the external surfaces of the holding piece lie(s) adjacent to the opposing surface of the well in order to ensure correct positioning and fixing of the holder.

In order to ensure firm clamping and thus secure fixing of the holder in the well, it is advantageous for the external surfaces of the supporting piece to lie against the lateral internal surface of the well, and to be so inclined downwards that a clamping effect is obtained between the holder and the well. The sloping or inclination of the external surfaces can thus be adapted to the slope of the well. Thus the holder may be firmly clamped against the well by means of a specified diameter.

In an advantageous embodiment, the holder is displaced with respect to the bottom of the well. In order to maintain a specified distance between the carrier and the bottom of the well, the holder has feet which are preferably positioned at the ends of the supporting pieces. In the case of a circular or triangular supporting piece, the position of the feet may also be in other places.

For secure insertion and to prevent tilting of the holder, it is advantageous if the downward facing feet are inclined inwards with respect to the supporting pieces or that their lateral external surfaces are inclined inwards.

In the case of one, at least, connecting piece arranged between the supporting pieces and the holding piece, the connecting piece is curved and directed upwards in the insertion direction. Preferably two connecting pieces are provided whose lateral external surfaces each lie against the lateral internal surface of the well and ensure stable support.

In addition to the connecting pieces, the holder has at least a fixing piece for secure positioning in the well; the fixing piece is directed upwards from the holding piece and, when inserted, lies against at least one lateral internal surface of the well. An additional contact surface is thus created on the well to facilitate the positioning of the holder and improve the fixing. The one, at least, fixing piece may preferably be designed to be flexible so that on insertion of the holder, it ensures secure contact with the lateral internal surface of the well in order to improve the fixing of the holder.

The substantial cylindrically shaped well may be round or multi-sided. In case of a circular well, the holder preferably lies against the lateral internal surface at three points at least. In a four-sided well, the holder lies against one of the lateral internal surfaces of the well.

The holder is designed in such a way that the carrier can be inserted into the well of the multiwell or microwell plate before the insertion of the holder.

The carrier may be used as a reservoir or an immobilisation site for chemicals or as a reaction site. In addition, the carrier may be a filter which is preferably disc-shaped and made of fleece.

The holder will preferably be manufactured by injection moulding, whereby the design may easily include several connection pieces, fixing pieces, adapted supporting pieces and holding pieces. The holder is made of plastic which is particularly suitable for injection moulding and, moreover, is also suitable for use for chemical analyses.

The object is further solved by using a multiwell in which the holder described above is inserted.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
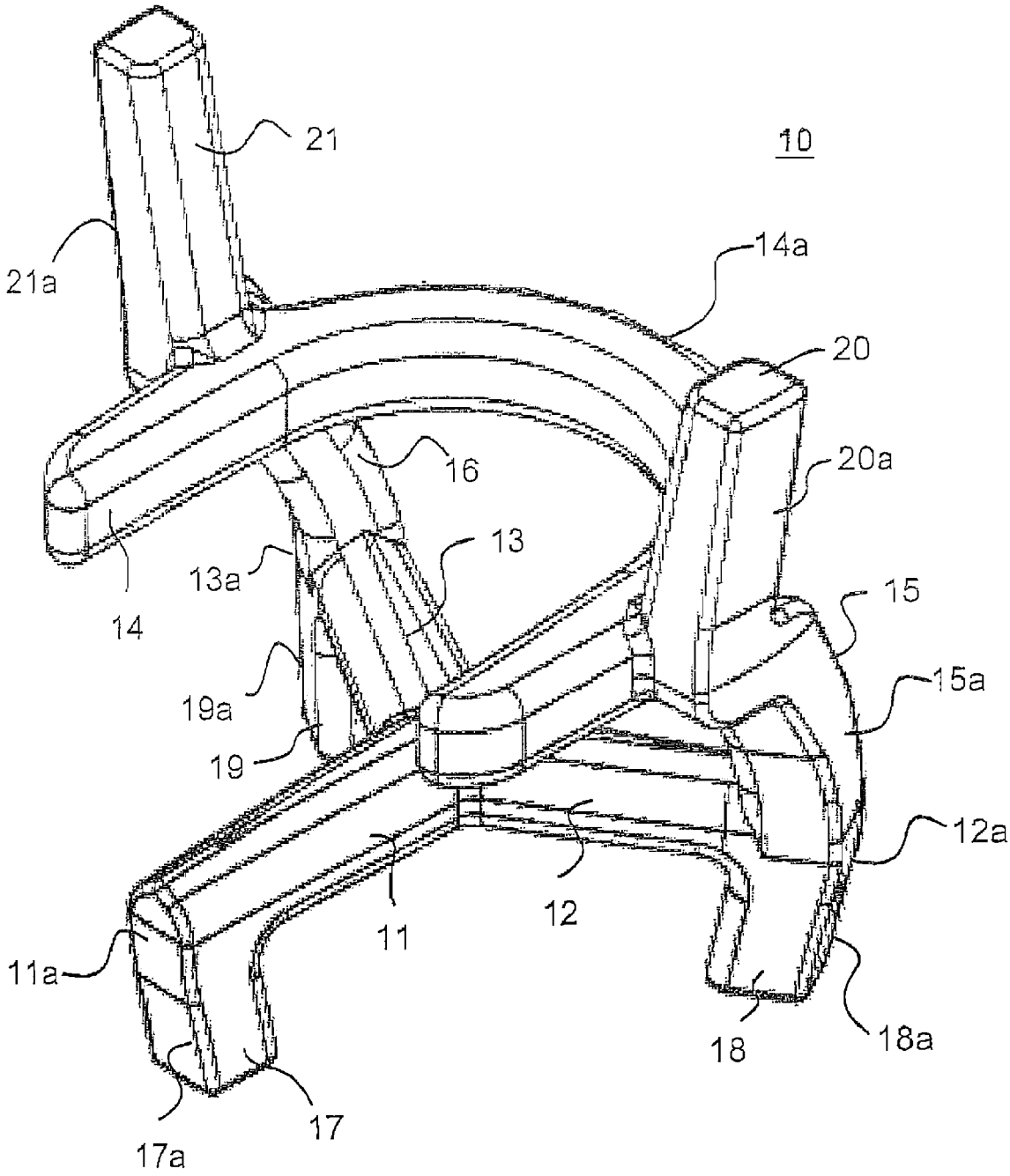
FIG. 1 shows a perspective view of a holder in accordance with this invention.
Figure 2:
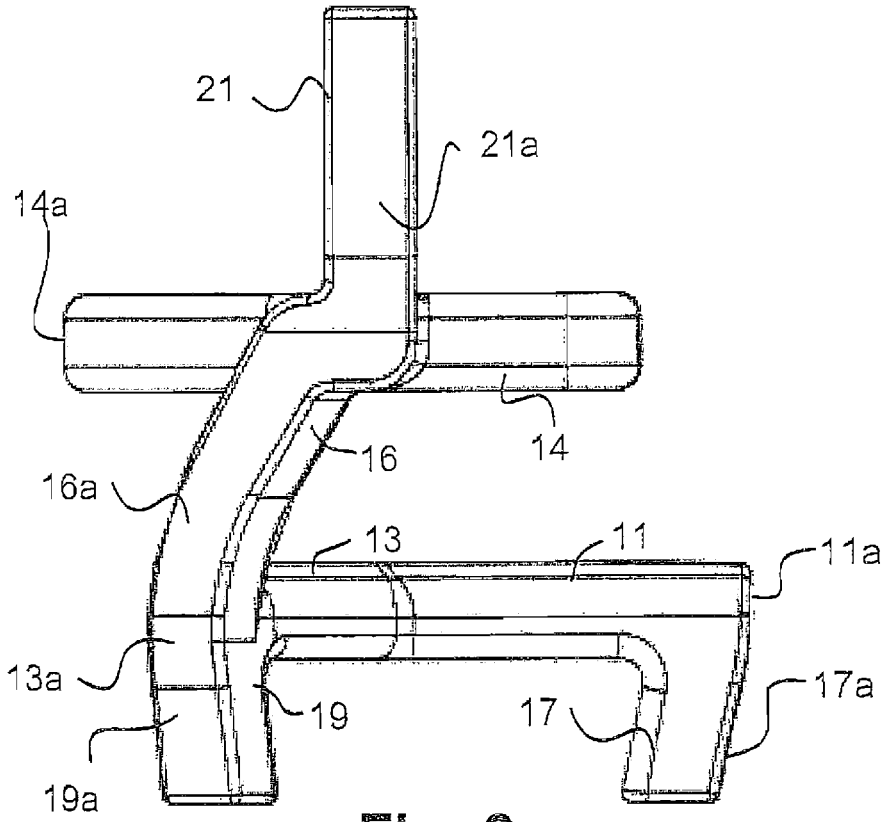
FIG. 2 shows a side view of a holder in accordance with this invention.
Figure 3:
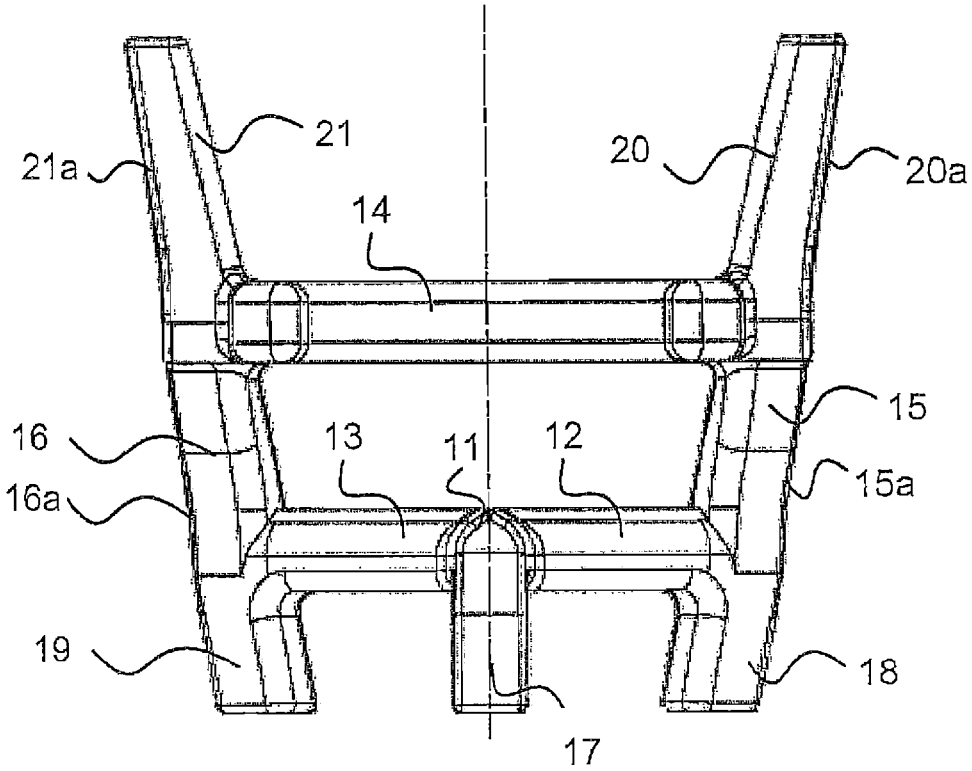
FIG. 3 shows another side view of a holder in accordance with this invention.
Figure 4:
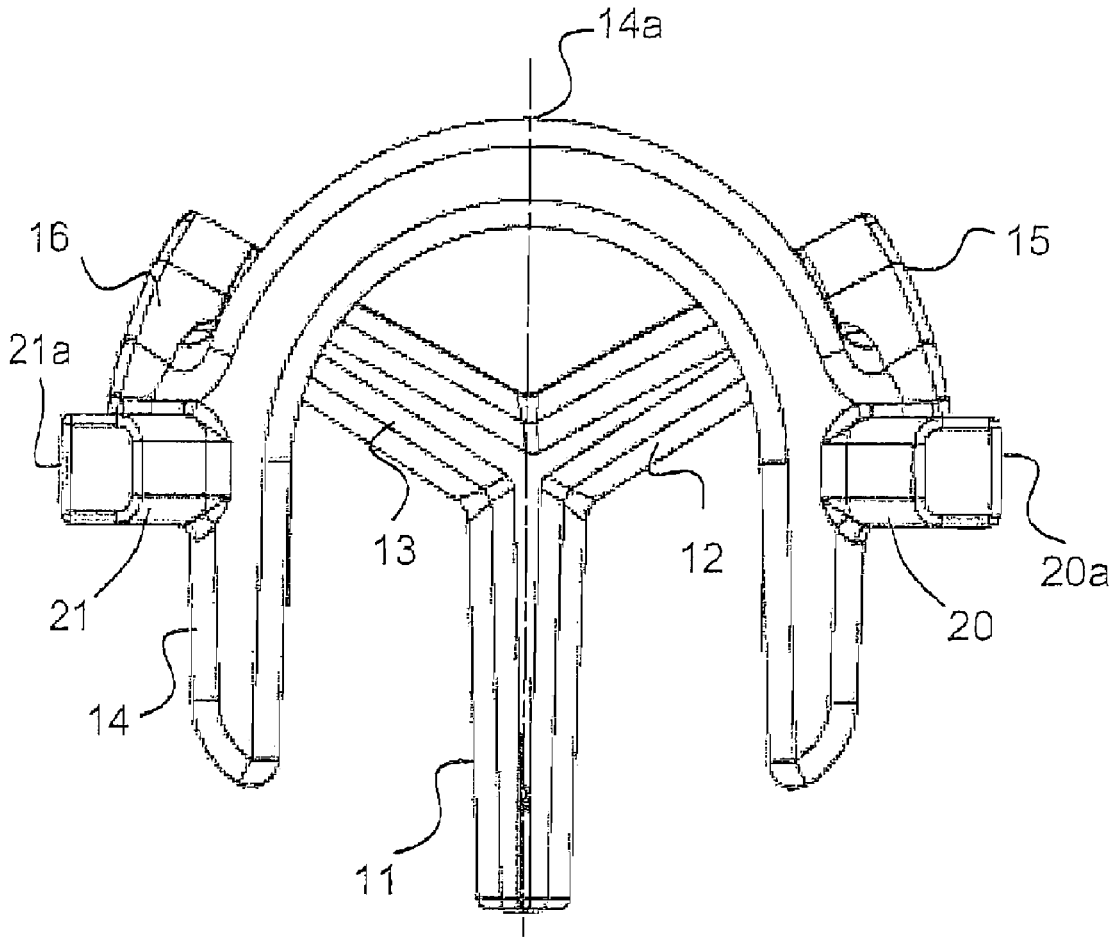
FIG. 4 shows a plan view of a holder in accordance with this invention.

FIG. 4 shows a plane view of a holder in accordance with this invention; and Reference is made to FIGS. 1-4 in the following. The holder in accordance with FIGS. 1-4 has three horizontal bars, which are also called supporting pieces 11, 12, 13, which are arranged in a star-shape and face outwards. The holder 10 shown in the figures is especially designed for a circular cylindrical well 40 as shown in FIG. 5*c* of a multiwell or microwell plate.

A U-shaped holding piece 14 is arranged horizontally and parallel to the supporting pieces 11, 12 and 13 and is connected via two connection pieces 15, 16 to the supporting pieces 11, 12, 13.

The supporting pieces 11, 12, 13 have lateral external surfaces 11*a*, 12*a* and 13*a*, at least one of which lies against the lateral internal surface 41 of the well 40 when inserted. In addition, the supporting pieces 11, 12, 13 each have a foot inclined inwards 17, 18, 19 which sits on the bottom of the well 40 and thus ensures that the carrier 30 is maintained at a specified distance from the bottom of the well 40.

Two connecting pieces 15 and 16 curve upwards in a slightly curved form respectively from the two supporting pieces 12 and 13 and between which stretches the U-shaped holding piece 14. As extensions of the connecting pieces 15 and 16, two fixing pieces 20 and 21 extend upwards in the direction of insertion. The external surfaces 20*a*, 21*a* of the fixing pieces 20 and 21, preferably lie together with the external surfaces 15*a*, 16*a* of the connecting pieces 15 and 16 against the lateral internal surface 41 of the well 40.

For additional fixing of the holder 10 in the well 40 when inserted, a lateral external surface 14*a* of the holding piece 14 lies against the lateral internal wall 41 of the well 40. Thus, secure fixing of the holder 10 in the well 40 is obtained offering stability against tipping over and also against slipping in the well. Secure support and fixing of the carrier 30 (see FIGS. 5*a* to 5*c*) results from the specified distance between the supporting pieces 11, 12 and 13 and the holding piece 14.

Figure 5A:
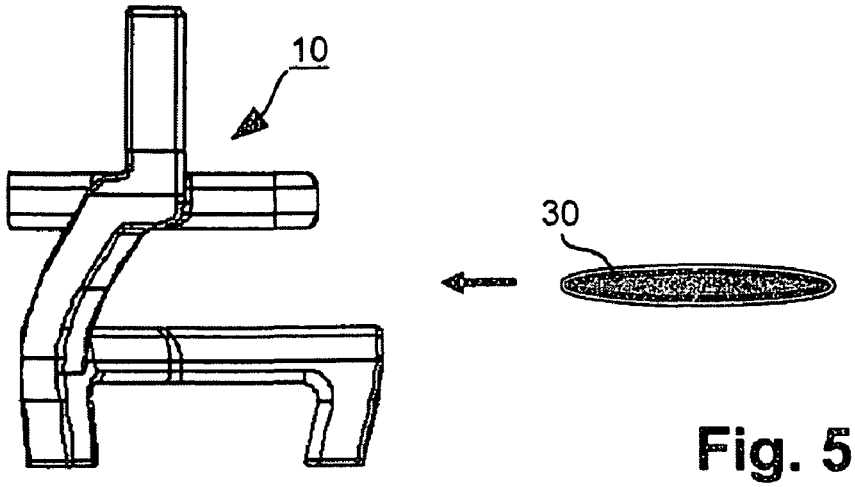
FIGS. 5*a*-5*c* show the process of inserting the carrier and the holder into a well.
Figure 5B:
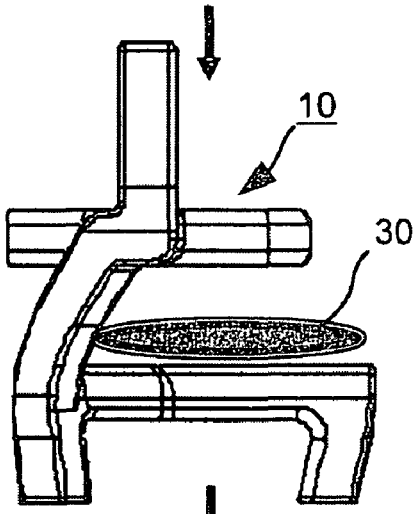
Figure 5C:
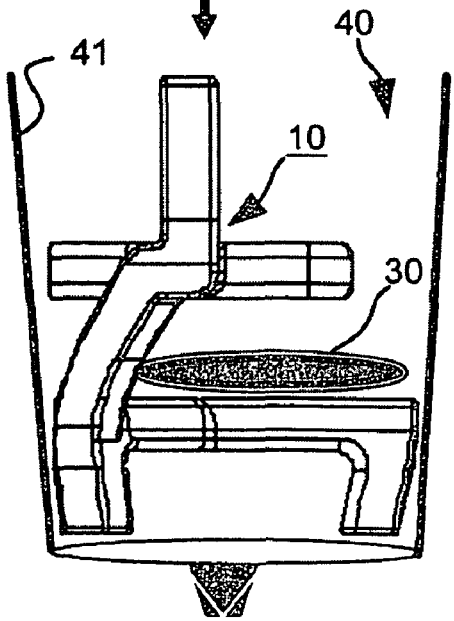

In FIGS. 5*a* to 5*c* is presented the process for inserting the carrier 30 in the form of a filter or fleece disc into the holder 10 and the insertion of the holder 10 with the carrier 30 into the well 40, for example, of a multiwell plate.

Preferably, the filter or fleece disc 30 is inserted in the space between the holding piece 14 and the supporting pieces 11, 12, 13 before insertion of the holder 10 into the well 40. The holder 10 with the carrier 30 will then, for example, be inserted into a well 40 in a multi-well or microwell plate by means of an automatic insertion device, whereby some of the lateral external surfaces 11*a*, 12*a*, 13*a*, 14*a*, 15*a*, 16*a*, 17*a*, 18*a*, 19*a*, 20*a* and 21*a* of the holder 10 ensure the maintenance of a specified position and secure fixing in the well 40.

Due to the feet 17, 18 and 19 of the supporting pieces 11, 12, 13, a specified distance is maintained between the bottom of the well 40 and the carrier 30 so that the carrier 30 lies loosely in position and can simultaneously be purged or surrounded using air, gases or liquids.

In an embodiment which is not shown, it is possible that the holder is not arranged at the bottom of a well 15, but via a clamping connection which clamps it firmly between the lateral external surfaces of the holder and the lateral internal surface 41 of the well 40.

It is also possible that the well 40 has lugs against which the holder butts or recesses within which the holder engages in order to maintain a specified position of the holder and thus ensure the position of the carrier in the well.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A holder for insertion into a cylinder-shaped well to support a flat shaped carrier, comprising:

a holding piece which, after the insertion of the holder into the well, is arranged horizontally in the well and serves for fixing of the carrier lying on a support, the support being arranged in the well under the holding piece, interconnected supporting pieces being contained in the support and arranged horizontally in the well, after insertion of the holder in the well, wherein the support having a different shape than the holding piece and at least one connecting piece running substantially vertically in the well and connecting the supporting pieces with the holding piece, wherein the flat shaped carrier is insertable on the support and under the holding piece before insertion of the holder in the well; and wherein, after insertion of the holder into the well, at least one of the lateral external surfaces of the support, the holding piece and the connecting piece of the holder contacts at least one lateral internal surface of the well;

wherein the support includes at least three horizontal supporting pieces arranged in the shape of a star or a triangle.

2. The holder in accordance with claim 1, wherein the holding piece is arranged in the direction of insertion above the support, wherein the support is arranged substantially parallel to the holding piece.

3. The holder in accordance with claim 1, wherein the holding piece is rod-shaped, U-shaped, V-shaped or circular.

4. The holder in accordance with claim 1, wherein the holder includes two connecting pieces arranged between the supporting pieces and the holding piece.

5. The holder in accordance with claim 1, wherein the external surfaces of the supporting pieces are inclined downwardly in the direction of insertion.

6. The holder in accordance with claim 1, wherein the surfaces of the supporting pieces inclined downwards in the direction of insertion are provided with feet.

7. The holder in accordance with claim 6, wherein the feet are tilted inwardly towards the inside of the well or have an inwardly inclined external surface.

8. The holder in accordance with claim 1, wherein the at least one connecting piece is curved.

9. The holder in accordance with claim 1, wherein the connecting piece has a lateral external surface contacting a lateral internal surface of the well after being inserted.

10. The holder in accordance with claim 1, wherein at least one fixing piece projects upwardly from the holding piece and contacts a lateral internal surface of the well after being inserted.

11. The holder in accordance with claim 1, wherein the holding piece is smaller in its horizontal extension in the well than the horizontal extension of the supporting pieces.

12. The holder in accordance with claim 1, wherein the cylinder-shaped well is round or multi-sided and has a depth corresponding to at least the vertical extension of the holder.

13. The holder in accordance with claim 1, wherein the carrier serves as a reservoir or immobilisation site for chemicals or as a reaction site.

14. The holder in accordance with claim 1, wherein the carrier is a filter or fleece.

15. The holder in accordance with claim 1, wherein the carrier is disc-shaped.

16. The holder in accordance with claim 1, wherein the holder is produced via injection moulding and is made of plastic.

17. A multiwell plate having a holder for insertion into a cylinder-shaped well to support a flat shaped carrier, comprising:

a holding piece which, after the insertion of the holder into the well, is arranged horizontally in the well and serves for fixing of the carrier lying on a support, the support being arranged in the well under the holding piece, interconnected supporting pieces being contained in the support and arranged horizontally in the well, after insertion of the holder in the well, wherein the support having a different shape than the holding piece; and at least one connecting piece running substantially vertically in the well and connecting the supporting pieces with the holding piece, wherein the flat shaped carrier is insertable on the support and under the holding piece before inserting the holder in the well; and wherein, after insertion of the holder into the well, at least one of the lateral external surfaces of the support, the holding piece and the connecting piece of the holder contacts at least one lateral internal surface of the well;

wherein the support includes at least three horizontal supporting pieces arranged in the shape of a star or a triangle.

* * * * *